US010323565B2

(12) United States Patent
Matsushita

(10) Patent No.: US 10,323,565 B2
(45) Date of Patent: Jun. 18, 2019

(54) COOLING STRUCTURE FOR INTERNAL COMBUSTION ENGINE

(71) Applicant: HONDA MOTOR CO., LTD., Tokyo (JP)

(72) Inventor: Koichiro Matsushita, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/866,189

(22) Filed: Jan. 9, 2018

(65) Prior Publication Data

US 2018/0223721 A1 Aug. 9, 2018

(30) Foreign Application Priority Data

Feb. 7, 2017 (JP) ..... 2017-020071

(51) Int. Cl.
*F01P 7/10* (2006.01)
*F01P 3/02* (2006.01)
(Continued)

(52) U.S. Cl.
CPC ..... *F01P 7/161* (2013.01); *F01L 1/02* (2013.01); *F01P 3/02* (2013.01); *F01P 3/20* (2013.01);
(Continued)

(58) Field of Classification Search
CPC ..... F01P 3/02; F01P 7/16; F01P 2003/021
See application file for complete search history.

(56) References Cited

U.S. PATENT DOCUMENTS 4,964,371 A * 10/1990 Maeda ..... F01P 7/167 123/41.1
5,275,231 A * 1/1994 Kuze ..... G05D 23/1333 123/41.1
(Continued)

FOREIGN PATENT DOCUMENTS

EP 0 671 552 A1 9/1995
JP 61-48917 U 4/1986
JP 2007-262928 A 10/2007

OTHER PUBLICATIONS

Extended European Search Report dated Apr. 6, 2018 for Application No. 17210807.8.

*Primary Examiner* — Long T Tran
(74) *Attorney, Agent, or Firm* — Birch, Stewart, Kolasch & Birch, LLP

(57) ABSTRACT

In an internal combustion engine, a thermostat valve for changing over between coolant circulation through a radiator-routing passage to coolant circulation through a bypass passage, is provided with a first valve for opening and closing the radiator-routing passage, and a second valve for opening and closing the bypass passage. The first and second valves and are operable concurrently. A cylinder coolant jacket around cylinder bores of a cylinder portion is partitioned into two in a cylinder axis direction to thereby form a main cylinder coolant jacket on a side of a cylinder head portion and a sub-cylinder coolant jacket on a side of a crankcase portion. The bypass passage is formed partly by the sub-cylinder coolant jacket. The above arrangement expedites warming-up during the engine start and achieves favorable appearance by a simplified structure.

17 Claims, 11 Drawing Sheets

(51) Int. Cl.

| | |
|---|---|
| ***F01P 7/16*** | (2006.01) |
| ***F01L 1/02*** | (2006.01) |
| ***F01P 5/10*** | (2006.01) |
| ***F01P 3/20*** | (2006.01) |
| *F01P 7/14* | (2006.01) |

(52) U.S. Cl.
CPC ..... *F01P 5/10* (2013.01); *F01P 7/162* (2013.01); *F01P 2003/027* (2013.01); *F01P 2007/146* (2013.01)

(56) References Cited

U.S. PATENT DOCUMENTS

| | | | | | |
|---|---|---|---|---|---|
| 5,488,937 | A * | 2/1996 | Kuze | F01P 7/165 | 123/41.08 |
| 2007/0295289 | A1* | 12/2007 | Hayashi | F01P 3/02 | 123/41.21 |
| 2008/0223316 | A1* | 9/2008 | Banta | F01P 7/16 | 123/41.1 |
| 2009/0194046 | A1* | 8/2009 | Shikida | F02F 1/14 | 123/41.74 |
| 2014/0026832 | A1* | 1/2014 | Yamashiro | F01P 3/02 | 123/41.08 |
| 2015/0159540 | A1* | 6/2015 | Misumi | F02F 1/16 | 123/41.44 |
| 2015/0247472 | A1* | 9/2015 | Nomura | F01P 3/02 | 123/41.74 |
| 2015/0345363 | A1* | 12/2015 | Marutani | F02F 1/166 | 123/41.44 |
| 2016/0010533 | A1* | 1/2016 | Matsumoto | F01P 3/02 | 123/41.08 |
| 2017/0074152 | A1* | 3/2017 | Woo | F01P 3/02 | |

* cited by examiner

COOLING STRUCTURE FOR INTERNAL COMBUSTION ENGINE

TECHNICAL FIELD

The present invention relates to a cooling structure for an internal combustion engine.

BACKGROUND ART

A well-known cooling structure for an internal combustion engine includes a radiator-routing passage by way of a radiator and a bypass passage that bypasses the radiator. The radiator-routing passage and the bypass passage form a coolant circulation path through which coolant is circulated by a water pump through water jackets in a cylinder portion and a cylinder head portion of the engine. The cooling structure further includes a thermostat valve that changes over between the circulation through the radiator-routing passage and the circulation through the bypass passage (see, for example, Patent Document 1).

PRIOR ART DOCUMENT

Patent Document

[Patent Document 1] JP 2007-262928 A

The cooling structure for an internal combustion engine disclosed in Patent Document 1 includes a wax-type, bottom bypass thermostat valve. The thermostat valve includes a first valve that opens and closes the radiator-routing passage, connected with a second valve (bottom valve) that opens and closes the bypass passage. The first valve and the second valve are integrally operable such that the second valve closes when the first valve opens, and vice versa.

When the engine is started, the first valve is closed and the second valve is opened, so that the coolant is circulated through the bypass passage to the water jackets in the cylinder portion and the cylinder head portion without passing through the radiator and warmup of the engine is thereby expedited. When coolant temperature is equal to or becomes higher than a predetermined temperature, the second valve is closed and the first valve is opened, so that the coolant passes through the radiator and the coolant thereby cooled is circulated through the water jackets in the cylinder portion and the cylinder head portion. The internal combustion engine can thereby be cooled.

SUMMARY OF THE INVENTION

Problems to be Solved by the Invention

In the cooling structure disclosed in Patent Document 1, the bypass passage that is opened and closed by the second valve of the thermostat valve is routed outside the engine main unit as a bypass hose connecting the thermostat valve with a water pump.

Not limited to the cooling structure disclosed in Patent Document 1, traditional cooling structures for internal combustion engines typically include a bypass passage as an external pipe.

Thus, the coolant that passes through the bypass passage during the engine start dissipates heat because of the external pipe being exposed to outside air, and this has been a hindrance to engine temperature increase by the warming-up operation of the engine during the engine start.

Additionally, because the bypass passage is routed outside the engine main unit, the structure tends to be complicated due to the increased number of parts used, so that outer appearance of the engine main unit is degraded because of complication of the area therearound.

The present invention has been made in view of the foregoing situations and it is an object of the present invention to provide a cooling structure for an internal combustion engine, capable of expediting warming-up operation during the engine start and achieving favorable outer appearance through a simplified structure.

Means for Solving the Problems

To achieve the foregoing object, the present invention provides a cooling structure for an internal combustion engine comprising: an engine main unit including a crankcase portion, a cylinder portion, and a cylinder head portion, the cylinder portion and the cylinder head portion having therein a cylinder coolant jacket and a cylinder head coolant jacket, respectively; a coolant pump for circulating coolant through a coolant circulation path formed in the cylinder coolant jacket and the cylinder head coolant jacket, the coolant circulation path including a radiator-routing passage by way of a radiator and a bypass passage bypassing the radiator; and a thermostat valve for changing over between coolant circulation through the radiator-routing passage and coolant circulation through the bypass passage;

wherein the thermostat valve includes a first valve for opening and closing the radiator-routing passage, and a second valve for opening and closing the bypass passage, the first valve and the second valve being operable concurrently; the cylinder coolant jacket is disposed around a cylinder bore in the cylinder portion and is partitioned into two in a cylinder axis direction to thereby form a main cylinder coolant jacket on a side of the cylinder head portion and a sub-cylinder coolant jacket on a side of the crankcase portion; and the bypass passage is formed partly by the sub-cylinder coolant jacket.

In accordance with the foregoing configuration, part of the bypass passage is formed by the sub-cylinder coolant jacket. This reduces use of the external pipe in the bypass passage. Thus, coolant that has been heated through circulation through the cylinder coolant jacket and the cylinder head coolant jacket during a warming-up operation at the start of the engine dissipates less heat when circulating through the bypass passage that bypasses the radiator because of the reduced use of the external pipe. Furthermore, the temperature of the coolant, which is further heated in the sub-cylinder coolant jacket, increases, so that engine warming-up is further expedited.

Additionally, the sub-cylinder coolant jacket provided in the cylinder portion forms part of the bypass passage. This facilitates formation of the bypass passage and reduces use of the external pipe in the bypass passage. Thus, a simplified structure including a reduced number of parts can be configured, cost can be reduced, and a lightweight internal combustion engine can be built. Additionally, outer areas surrounding the engine main unit can be simplified and favorable outer appearance can be maintained.

In the foregoing configuration, preferably, the main cylinder coolant jacket has a volume greater than a volume of the sub-cylinder coolant jacket.

In accordance with the foregoing configuration, the main cylinder coolant jacket on the side of the cylinder head portion has a volume greater than the volume of the sub-cylinder coolant jacket on the side of the crankcase portion.

Thus, the cylinder portion can be efficiently cooled during the ordinary operation of the internal combustion engine following the warming-up operation, while the sub-cylinder water jacket is being used as the bypass passage.

In the foregoing configuration, preferably, the second valve has formed therein a leak passage through which coolant leaks when the second valve is in a closed position.

In accordance with the foregoing configuration, the coolant leaks through the leak passage to the bypass passage even when the second valve is closed during the ordinary operation of the internal combustion engine. A minimal amount of coolant is thereby allowed to flow through the sub-cylinder water jacket. Uneven cooling performance of the cylinder portion can thus be prevented and the cylinder portion can be cooled even more effectively.

In the foregoing configuration, preferably, the thermostat valve is integrated with the engine main unit.

In accordance with the foregoing configuration, part of the bypass passage that is opened and closed by the second valve of the thermostat valve, specifically, the part between the second valve and the sub-cylinder coolant jacket of the cylinder portion is formed in the engine main unit. Use of the external pipe can thereby be further reduced, so that heat dissipation from the external pipe during the warming-up operation can be further reduced and warming-up can be further expedited.

In addition, the reduction in use of the external pipe shortens the bypass passage as much as possible, so that pipe resistance can be minimized.

In the foregoing configuration, preferably, the cylinder portion includes a plurality of cylinder bores arrayed in series with each other, and the thermostat valve is disposed adjacent one of outermost cylinder bores disposed on two lateral ends in a direction in which the cylinder bores are arrayed.

In accordance with the foregoing configuration, the thermostat valve is disposed adjacent one of the outermost cylinder bores disposed on two lateral ends in the direction in which the cylinder bores are arrayed in series with each other in the cylinder portion. Thus, the sub-cylinder coolant jacket can be used over a long distance as part of the bypass passage opened and closed by the second valve of the thermostat valve. During the warming-up operation, the coolant that circulates through the bypass passage can thereby be efficiently heated over a long distance, so that warming-up is further expedited.

In the foregoing configuration, preferably, the coolant pump is disposed on a side opposite to the thermostat valve in the direction in which the cylinder bores are arrayed in the internal combustion engine.

In accordance with the foregoing configuration, the thermostat valve and the coolant pump are disposed on either end across the cylinder bores in the direction in which the cylinder bores are arrayed. Thus, the sub-cylinder coolant jacket is allowed to form a substantial part of the bypass passage. Thus, the use of the external pipe can be reduced and heat dissipation from the external pipe can be reduced for expediting of the warming-up. Additionally, outer appearance can be improved and reduction in size and weight of the internal combustion engine can be further promoted.

Additionally, the sub-cylinder coolant jacket as the bypass passage includes the two flow channels through which coolant is passed in the direction in which the cylinder bores are arrayed, to thereby allow the coolant to flow through the two flow channels in a bifurcated manner in an identical direction. The configuration results in a large flow channel cross-sectional area, a short flow channel length, and small pipe resistance. Thus, the internal combustion engine can be further reduced in size through the use of a compact water pump delivering a small pump capacity.

In the foregoing configuration, preferably, the coolant pump is disposed on a side identical to a side on which the thermostat valve is disposed in the direction in which the cylinder bores are arrayed in the internal combustion engine.

In accordance with the foregoing configuration, the thermostat valve and the coolant pump are disposed on the same side in the direction in which the cylinder bores are arrayed. Thus, the sub-cylinder coolant jacket is allowed to form a substantial part of the bypass passage. Thus, the use of the external pipe can be reduced and heat dissipation from the external pipe can be reduced for expediting of the warming-up. Additionally, outer appearance can be improved and reduction in size and weight of the internal combustion engine can be further promoted.

Additionally, the sub-cylinder coolant jacket as the bypass passage includes the two flow channels through which coolant is passed in the direction in which the cylinder bores are arrayed and represents a circuit route around the inline cylinder bores, extending from a first end in the cylinder array direction through a first flow channel, by way of a second end, back to a second flow channel. Thus, the coolant is heated by the long flow channel of the bypass passage during the warming-up operation, so that warming-up is even further expedited.

In the foregoing configuration, preferably, the cylinder portion is disposed to extend superiorly from the crankcase portion; a starting motor is disposed on the crankcase portion adjacent the cylinder portion; and the starter motor is disposed on a side of the cylinder bores with part of the sub-cylinder coolant jacket positioned between the cylinder bores and the starter motor.

In accordance with the foregoing configuration, the starting motor is disposed on the crankcase portion adjacent the cylinder portion that extends superiorly from the crankcase portion, so that the starting motor can be disposed in a space-efficient manner. Additionally, the starting motor is disposed on the side opposite to the cylinder bores across part of the sub-cylinder coolant jacket. Thus, the coolant flowing through the sub-cylinder coolant jacket blocks heat generated by the cylinder bores and thermal effect on the starting motor can be reduced.

Effects of the Invention

In the present invention, the cylinder coolant jacket is partitioned into two in the cylinder axis direction to thereby form the main cylinder coolant jacket on the side of the cylinder head portion and the sub-cylinder coolant jacket on the side of the crankcase portion, and the bypass passage is formed partly by the sub-cylinder coolant jacket. Thus, use of the external pipe in the bypass passage can be reduced and the coolant that has been heated through circulation through the cylinder coolant jacket and the cylinder head coolant jacket during the warming-up operation at the start of the engine dissipates less heat when circulating through the bypass passage that bypasses the radiator because of the reduced use of the external pipe. Furthermore, the temperature of the coolant, which is further heated in the sub-cylinder coolant jacket, increases, so that warming-up is further expedited.

Additionally, the sub-cylinder coolant jacket located in the cylinder portion forms part of the bypass passage. This facilitates formation of the bypass passage and reduces use of the external pipe in the bypass passage. Thus, a simplified structure including a reduced number of parts can be configured, cost can be reduced, and a lightweight internal combustion engine can be built. Additionally, outer areas surrounding the engine main unit can be simplified and favorable outer appearance can be maintained.

MODE FOR CARRYING OUT THE INVENTION

A specific embodiment to which the present invention is applied will be described below with reference to the drawings.

Figure 1:
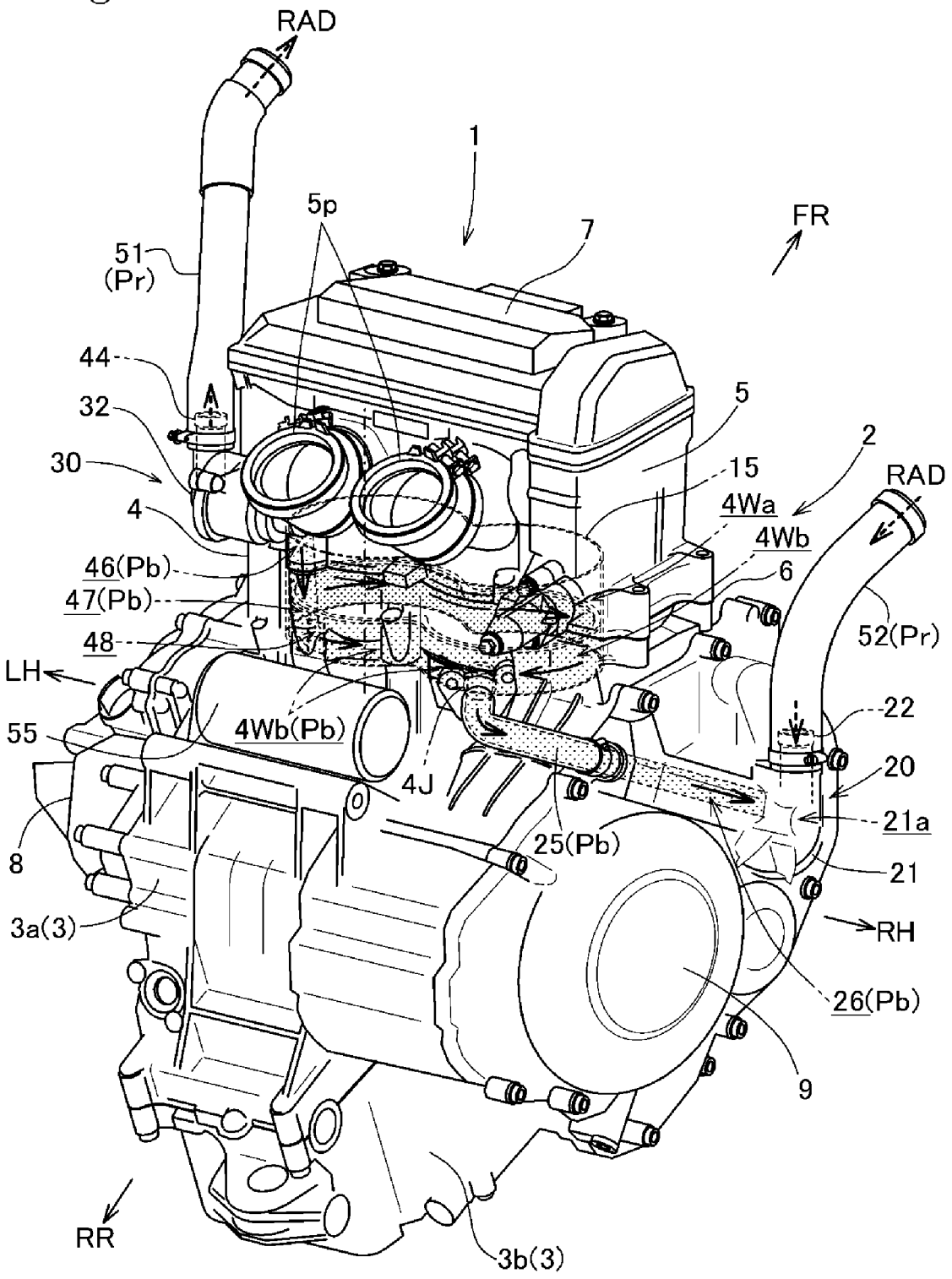
FIG. 1 is a perspective view generally depicting an internal combustion engine that includes a cooling structure according to an embodiment of the present invention.

Referring to FIG. 1, an internal combustion engine 1 to which the embodiment of the present invention is applied is mounted is a saddled vehicle or, in particular, a motorcycle. The internal combustion engine 1 is an inline two-cylinder, four-stroke water-cooled internal combustion engine.

Figure 2:
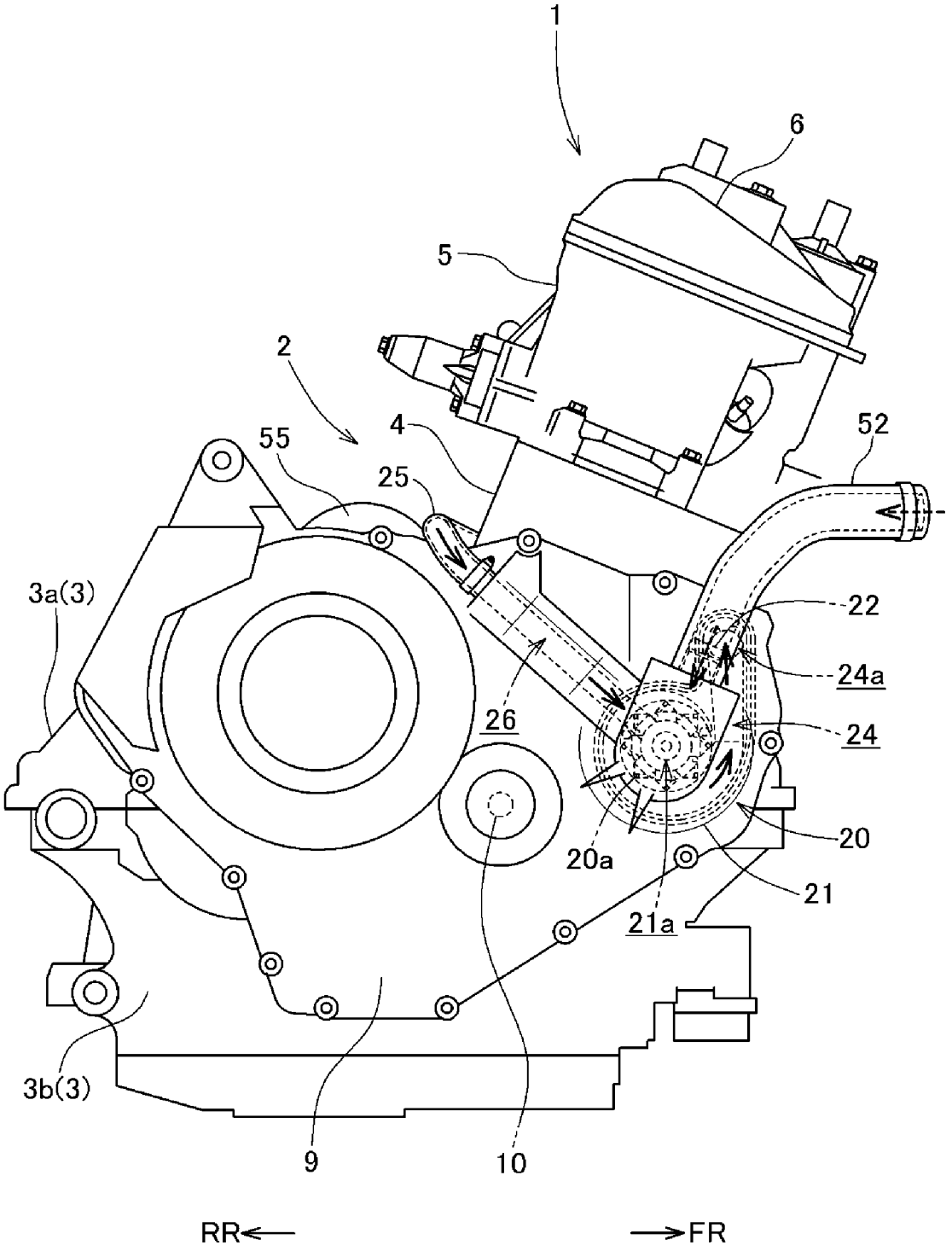
FIG. 2 is a right side elevational view of the internal combustion engine.

As shown in FIGS. 1 and 2, the internal combustion engine 1 is mounted transversely on the vehicle, with a crankshaft 10 thereof oriented in a lateral direction.

Throughout the description given hereunder, expressions indicating directions including front and rear, and right and left, mean the same directions as those on a vehicle facing in a straight-forward direction. In the drawings, arrow FR indicates forward of the vehicle, arrow RR indicates rearward of the vehicle, arrow LH indicates leftward of the vehicle, and arrow RH indicates rightward of the vehicle.

As depicted in FIGS. 1 and 2, an engine main unit 2 of the internal combustion engine 1 includes a crankcase portion 3, a cylinder portion 4, and a cylinder head (cylinder head portion) 5. The crankcase portion 3 journals the crankshaft 10. The cylinder portion 4 extends superiorly from the crankcase portion 3. The cylinder head 5 is disposed on the cylinder portion 4 via a gasket 6.

The crankcase portion 3 includes an upper-side crankcase 3*a* and a lower-side crankcase 3*b* that sandwich the crankshaft 10 from above and below to thereby journal the crankshaft 10. The cylinder portion 4 extends from the upper-side crankcase 3*a* obliquely superiorly at a slightly anteriorly inclined angle. The upper-side crankcase 3*a* and the cylinder portion 4 are formed integrally as a cylinder block.

A cylinder head cover 7 is placed over the cylinder head 5.

A left case cover 8 and a right case cover 9 cover left and right lateral surfaces of the crankcase portion 3, respectively.

A transmission chamber in which a transmission mechanism is housed is formed in the crankcase portion 3, posterior to a crank chamber that journals the crankshaft 10. The internal combustion engine 1 constitutes a power unit structure.

As depicted in FIG. 1, a starter motor 55 is disposed superior to the transmission mechanism above the crankcase portion 3.

The starter motor 55 is disposed transversely in the lateral direction along a rear lateral surface of the cylinder portion 4, adjacent to the cylinder portion 4 that extends superiorly from the crankcase portion 3.

Figure 3:
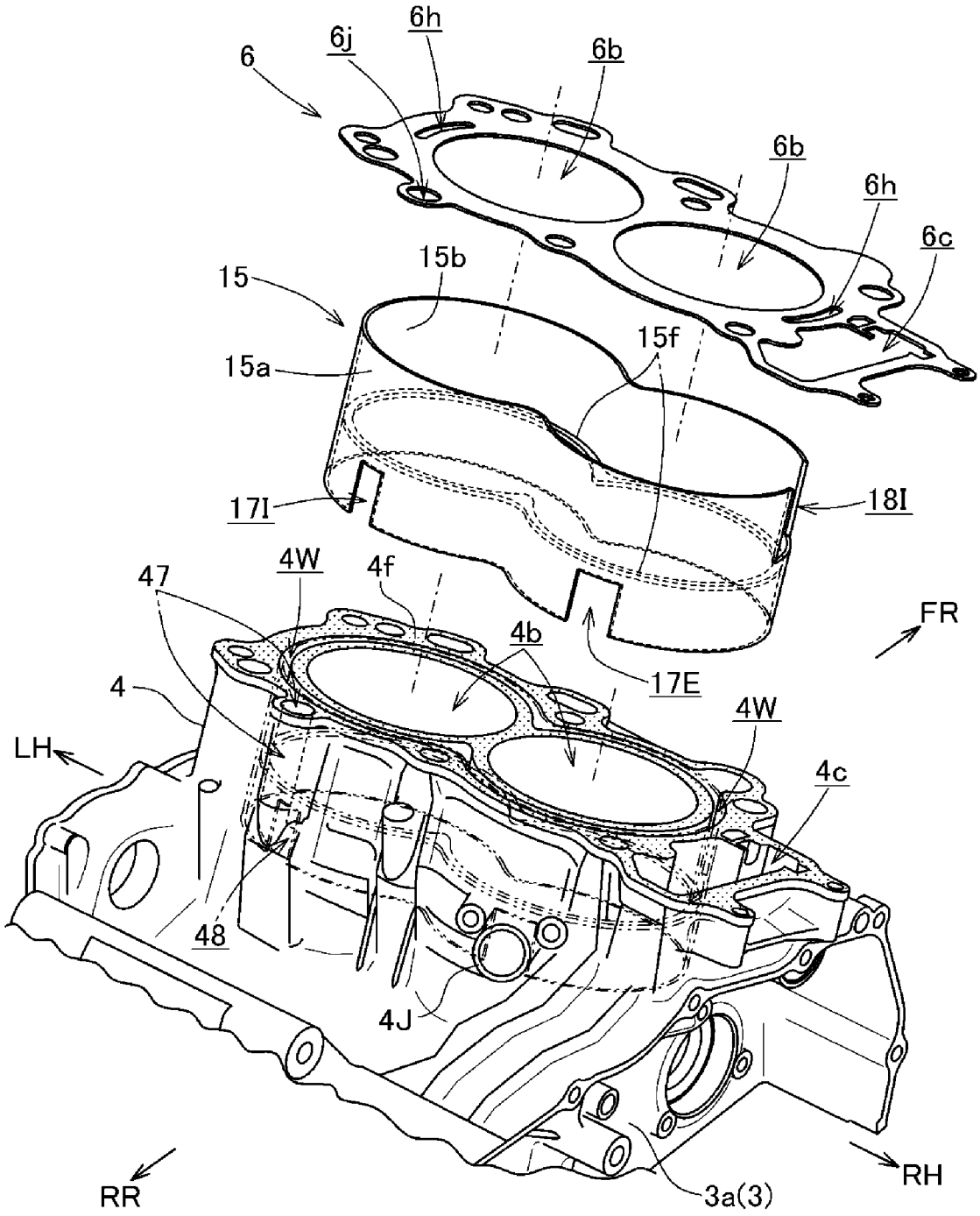
FIG. 3 is an exploded perspective view of a cylinder block, a partition member, and a gasket of the internal combustion engine.

Reference is made to FIG. 3. The cylinder portion 4 includes cylinder bores 4*b* formed therein in juxtaposition to each other in the lateral direction. The cylinder portion 4 further includes a rectangular cam chain chamber 4*c* formed therein on the right of the cylinder bores 4*b*.

Additionally, a cylinder water jacket 4W is formed around the left and right cylinder bores 4*b* in the cylinder portion 4.

The cylinder water jacket 4W is composed of cylindrical groove portions formed around the respective cylinder bores 4*b* juxtaposed to each other and combined together at a central constricted connection therebetween to thereby form a single loop tubular groove. The cylinder water jacket 4W is open in an abutment surface 4*f* relative to the cylinder head 5.

The tubular groove of the cylinder water jacket 4W is formed into a channel defined by groove lateral surfaces that face each other on an inside and an outside of the loop and a groove bottom surface.

Reference is made to FIG. 3. A partition member 15 is inserted in the cylinder water jacket 4W that is formed into the loop-shaped tubular groove, which includes the cylindrical groove portions on the left and right sides of the central constricted connection disposed between the cylindrical groove portions. The partition member 15 is a tubular plate member formed into a loop shape having cylindrical portions on the left and right sides of a central constricted connection disposed between the cylindrical portions.

The partition member 15 is a plate member formed of a resin.

The tubular partition member 15 is a resin plate member having a thickness thinner than a groove width of the cylinder water jacket 4W. The partition member 15 is fitted into the cylinder water jacket 4W by having an outer lateral surface 15*a* of the partition member 15 in contact with an outer groove lateral surface of the cylinder water jacket 4W.

The partition member 15 has a flange 15*f* formed in a predetermined region closer to a lower end thereof on an inner lateral surface 15*b* thereof. The flange 15*f* is formed into a loop shape protruding inwardly (see FIG. 3).

Figure 4:
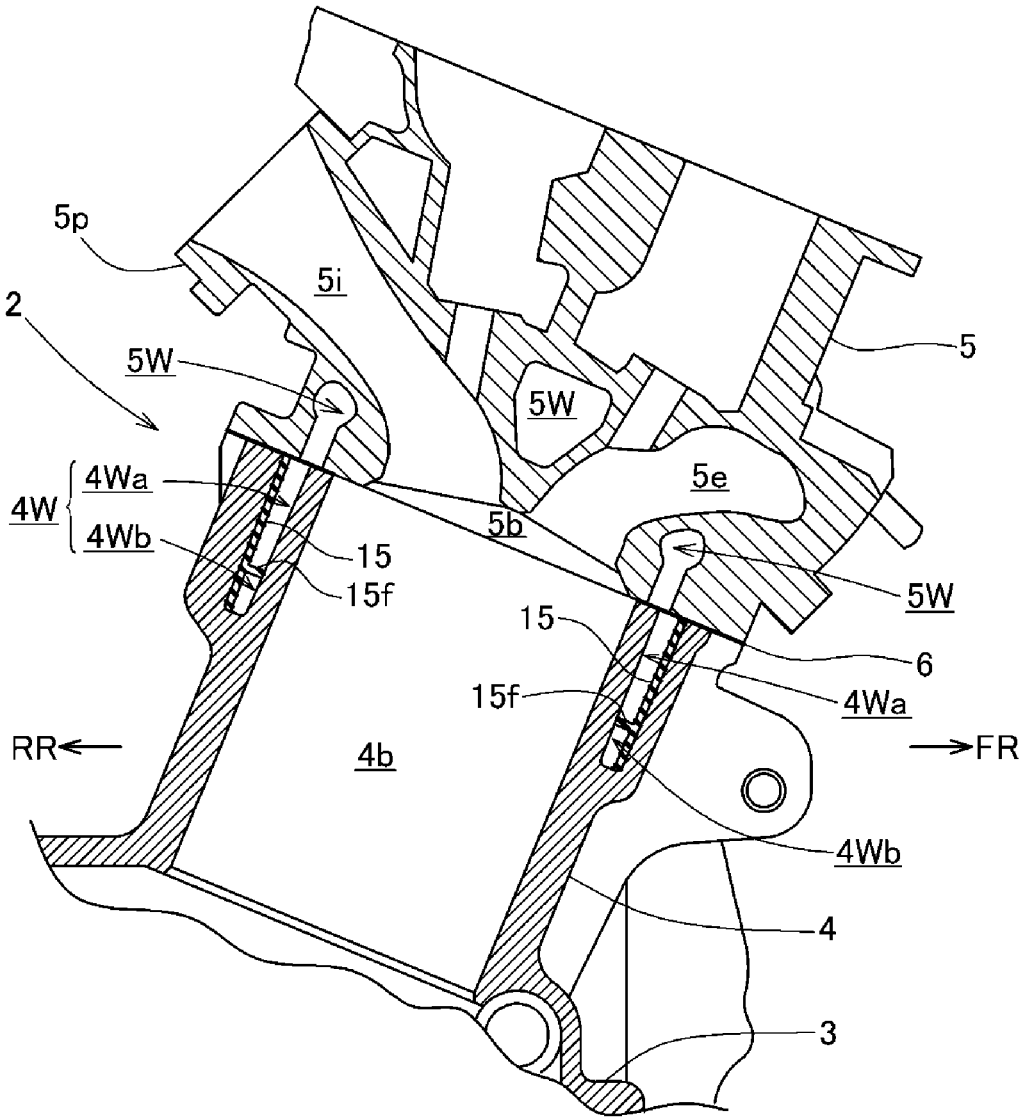
FIG. 4 is a sectional view of the cylinder block combined with a cylinder head via the gasket.

Reference is made to FIG. 4. When the partition member 15 is inserted in the cylinder water jacket 4W, the outer lateral surface 15*a* of the partition member 15 contacts the groove outer lateral surface of the cylinder water jacket 4W, and the flange 15*f* has an inner circumferential end contacting an inner groove lateral surface of the cylinder water jacket 4W.

Thus, as shown in FIG. 4, the cylinder water jacket 4W is partitioned by the flange 15*f* of the partition member 15 into two in a cylinder axis direction. Specifically, a main cylinder water jacket 4Wa is formed on the side of the cylinder head 5 (upper side) and a sub-cylinder water jacket 4Wb is formed on the side of the crankcase portion 3 (lower side).

Because the flange 15*f* is formed at a position closer to the lower end of the partition member 15, the main cylinder water jacket 4Wa has a volume greater than a volume of the sub-cylinder water jacket 4Wb.

It is noted that, as depicted in FIG. 3, an inflow communication port 17I is cut out from the lower end of the partition member 15 at a part of a left rear portion of the left cylindrical portion, lower than the flange 15*f*. Additionally, an outflow communication port 17E is cut out from the lower end of the partition member 15 at a part of a right rear portion of the right cylindrical portion, lower than the flange 15*f*.

A connection opening 4J that opens to the outside is formed in a portion of a rear lateral wall of the cylinder portion 4, to which the outflow communication port 17E of the partition member 15 corresponds, when the partition member 15 is fitted in the cylinder water jacket 4W in the cylinder portion 4 (see FIG. 3).

Thus, the connection opening 4J communicates with the lower sub-cylinder water jacket 4Wb partitioned by the flange 15*f* of the cylinder water jacket 4W via the outflow communication port 17E in the partition member 15.

Additionally, an inflow communication port 18I is cut out from an upper end of the partition member 15 at a part on the right lateral portion of the right cylindrical portion, above the flange 15*f*.

Reference is made to FIG. 4. A cylinder head water jacket 5W is formed in the cylinder head 5 around a combustion chamber 5*b* corresponding to the cylinder bore 4*b* of the cylinder portion 4. The cylinder head water jacket 5W is formed to be open in the abutment surface of the cylinder portion 4 so as to correspond to the cylinder water jacket 4W.

Referring to FIGS. 3 and 4, the cylinder water jacket 4W in the cylinder portion 4 and the cylinder head water jacket 5W in the cylinder head 5 are partly partitioned by the gasket 6 clamped between the cylinder portion 4 and the cylinder head 5.

Reference is made to FIG. 3. The gasket 6 has round holes 6*b* and a rectangular hole 6*c* formed therein. The round holes 6*b* correspond in position to the cylinder bores 4*b* in the cylinder portion 4. The rectangular hole 6*c* corresponds in position to the cam chain chamber 4*c*. The portion corresponding to the cylinder water jacket 4W around the round holes 6*b* is closed except for arcuate communication holes 6*h*. Thus, the gasket 6 partitions the cylinder water jacket 4W and the cylinder head water jacket 5W excepting the openings in the communication holes 6*h*.

The communication holes 6*h* in the gasket 6 are formed at positions corresponding to left and right lateral ends of the cylinder water jacket 4W that is formed into the loop shape with the central constriction.

Thus, the cylinder water jacket 4W of the cylinder portion 4 and the cylinder head water jacket 5W of the cylinder head 5 are generally partitioned by the gasket 6 and only the arcuate communication holes 6*h* on the left and right lateral ends provide communication.

As depicted in FIG. 4, the cylinder head 5 has an intake port 5*i* extending to curve obliquely upwardly toward the rear from the combustion chamber 5*b*. The intake port 5*i* has an upstream end forming an intake connection pipe portion 5*p* protruding to the rear.

Additionally, the cylinder head 5 has an exhaust port 5*e* extending obliquely upwardly toward the front from the combustion chamber 5*b*.

The cylinder head water jacket 5W is formed also around the intake port 5*i* and the exhaust port 5*e*.

As FIGS. 1 and 2 show, a water pump 20 that circulates coolant is disposed at a front portion anterior to the crankshaft 10 of the right case cover 9 that covers the right lateral surface of the crankcase portion 3 in the internal combustion engine 1.

The water pump 20 includes an impeller 20*a* housed in a pump body formed on a lateral wall of the right case cover 9. The impeller 20*a* is housed in a pump cover 21 from the outside.

The pump cover 21 has an intake chamber 21*a* defined on the right of the impeller 20*a*. An intake connection pipe 22 is provided to protrude from the intake chamber 21*a*. A radiator outflow hose 52 extending from a radiator 50 is connected with the intake connection pipe 22.

Additionally, a bypass passage hole 26 is drilled in a wall of the right case cover 9 to extend obliquely upwardly toward the rear from the intake chamber 21*a*.

As depicted in FIG. 1, a bypass communication hose 25 connects an upstream end of the bypass passage hole 26 with the connection opening 4J formed in the rear lateral wall of the cylinder portion 4.

The upstream end of the bypass passage hole 26 and the connection opening 4J are both disposed on the right-hand side of the internal combustion engine 1 and are located close to each other. The bypass communication hose 25 that connects the upstream end of the bypass passage hole 26 with the connection opening 4J can thus be short in length.

The connection opening 4J communicates with the lower sub-cylinder water jacket 4Wb partitioned by the flange 15*f* of the partition member 15 of the cylinder water jacket 4W via the outflow communication port 17E in the partition member 15. Thus, the lower sub-cylinder water jacket 4Wb communicates with the intake chamber 21*a* of the water pump 20 via the connection opening 4J, the bypass communication hose 25, and the bypass passage hole 26.

Reference is made to FIG. 2. Coolant drawn into the central intake chamber 21*a* in the water pump 20 from the intake connection pipe 22 or the bypass passage hole 26 is discharged to a delivery path 24 on the outer circumference by a centrifugal force through rotation of the impeller 20*a*. Guided into the delivery path 24, the coolant is then delivered to the cylinder block side from a delivery port 24*a* in the right case cover 9. The coolant then flows into the upper main cylinder water jacket 4Wa via the inflow communication port 18I in the partition member 15.

Figure 5:
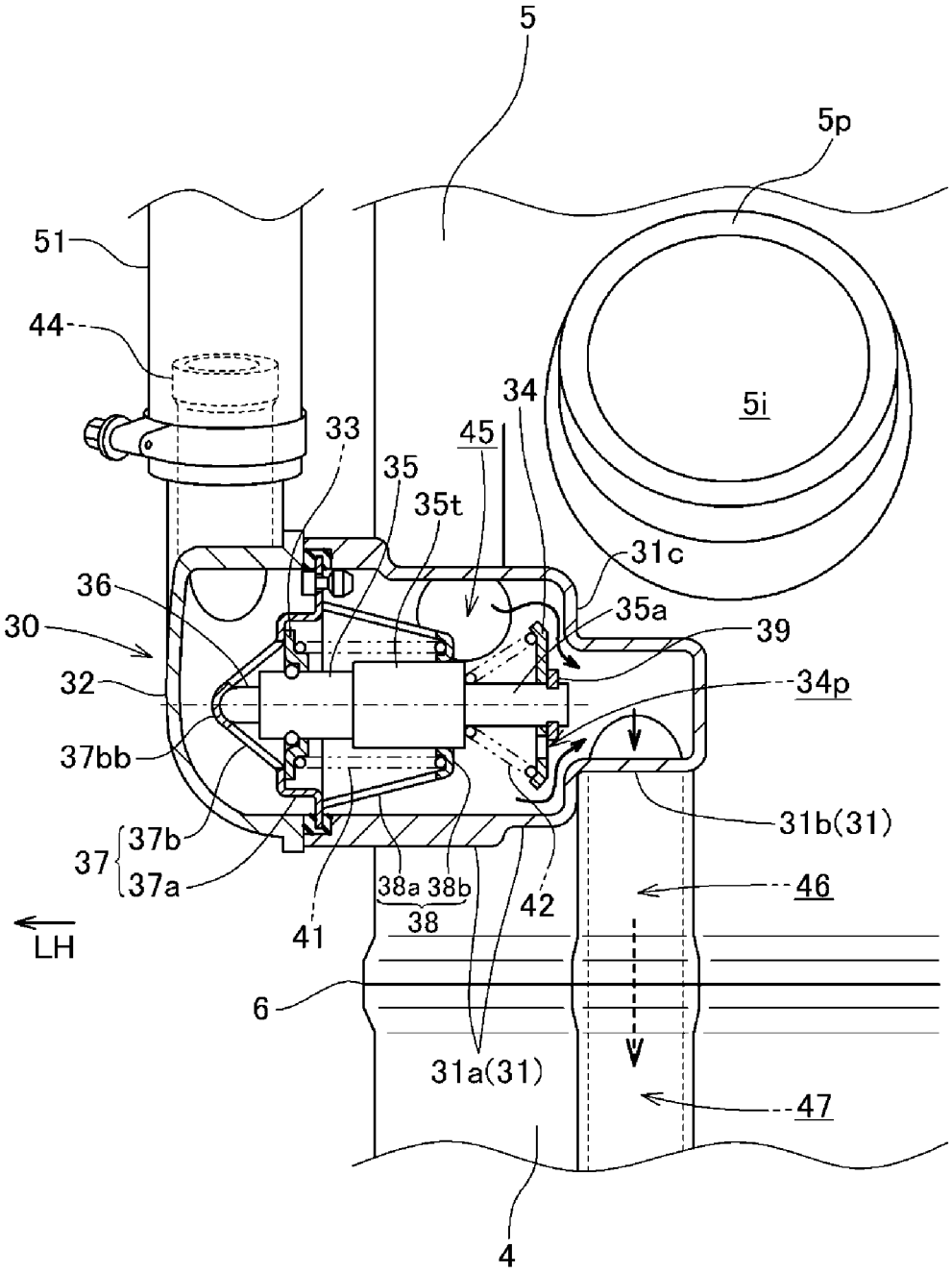
FIG. 5 is a rear elevational view, partly in section, of an engine main unit, particularly depicting a thermostat valve and parts around the thermostat valve when coolant temperature is low.

Reference is made to FIGS. 1 and 5. The cylinder head 5 includes a thermostat valve 30 integrally formed on the rear lateral wall of the cylinder head 5 at a left end of the rear lateral surface from which the intake connection pipe portion 5*p* protrudes.

Figure 6:
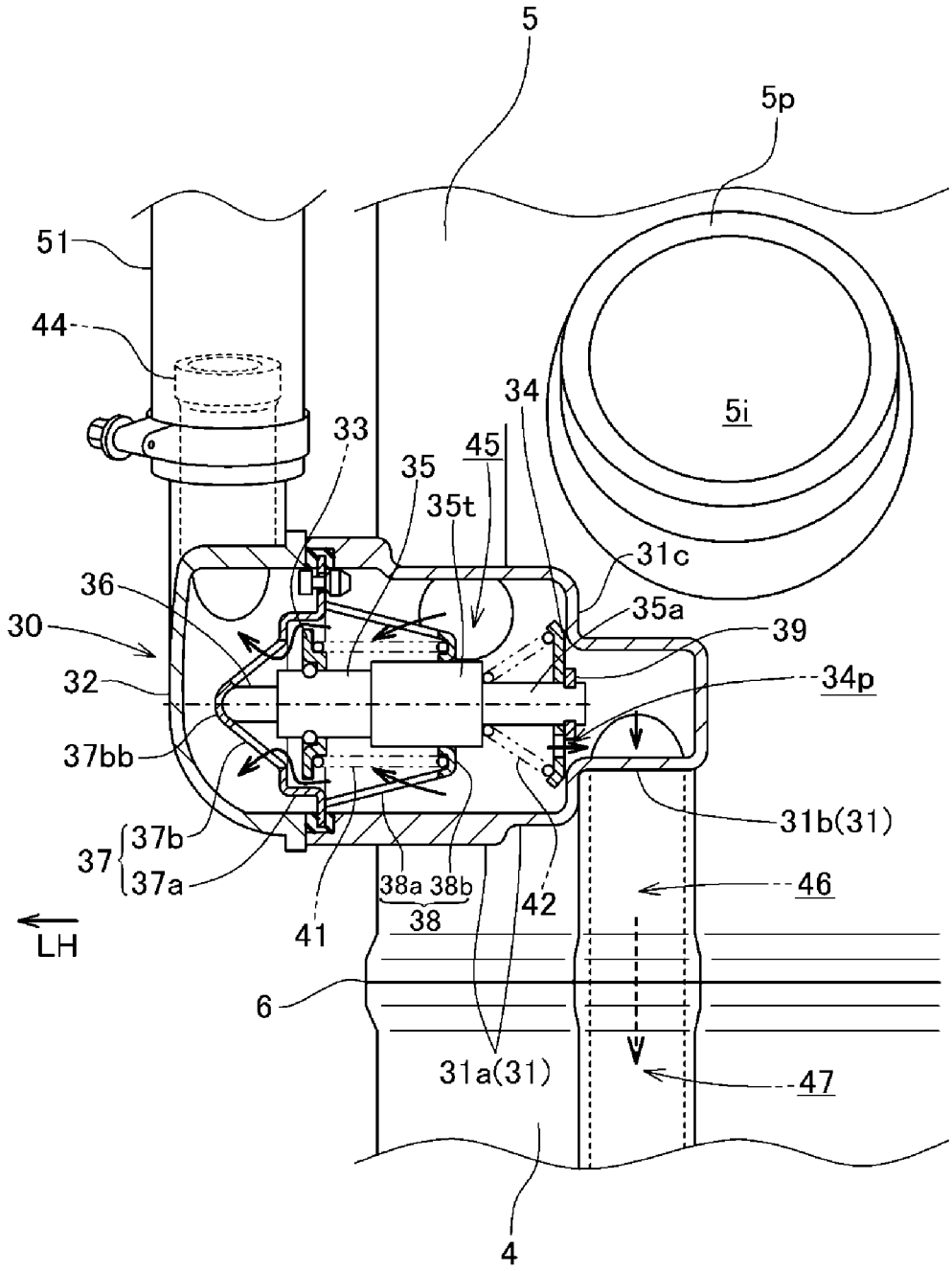
FIG. 6 is a rear elevational view, partly in section, of the engine main unit, particularly depicting the thermostat valve and the parts around the thermostat valve when the coolant temperature is high.

As depicted in FIGS. 5 and 6, the thermostat valve 30 includes a casing 31 integrally formed with the rear lateral wall of the cylinder head 5. A lid member 32 covers an opening that opens to the left. The thermostat valve 30 includes a first valve 33 and a second valve 34 disposed thereinside.

Referring to FIGS. 5 and 6, an annular valve seat 37 is clamped and fixed between the casing 31 and the lid member 32 inside the thermostat valve 30. The valve seat 37 integrally includes an annular seat portion 37*a* and a band-shaped retainer portion 37*b*. The annular seat portion 37*a* has a valve opening in the center thereof. The retainer portion 37*b* is bent into a dogleg shape to thereby have both ends connected with a circumferential edge of the valve opening in the annular seat portion 37*a*.

The retainer portion 37*b* protrudes from the annular seat portion 37*a* of the valve seat 37 into the internal space of the lid member 32 on the left.

A spring receiving support member 38 extends from the annular seat portion 37*a* of the valve seat 37 into the casing 31 on the right.

The spring receiving support member 38 includes a pair of support pieces 38*a* and an annular spring receiving portion 38*b*. The support pieces 38*a* extend to the right from the valve seat 37. The spring receiving portion 38*b* is formed on the right end of the support pieces 38*a*.

The first valve 33 is urged by a coil spring 41 having a first end supported by the spring receiving portion 38*b* of the spring receiving support member 38, and thereby abuts on the annular seat portion 37*a* of the valve seat 37.

A thermoelement 35 passes through the first valve 33. The thermoelement 35 has a left end passing through the central valve opening in the annular valve seat 37 with an ample clearance therefrom. When the first valve 33 abuts on the annular seat portion 37*a* of the valve seat 37, the valve opening in the valve seat 37 is closed to establish a valve-closed state, so that an internal space of the casing 31 is partitioned from the internal space of the lid member 32.

The thermoelement 35 includes a portion toward the right-hand side, which portion, having an enlarged diameter, assumes a temperature-sensing portion 35*t* in which a thermally expandable material, such as a wax, is packed.

The thermoelement 35 is supported such that the temperature-sensing portion 35*t* is slidable along the annular spring receiving portion 38*b* of the spring receiving support member 38. Meanwhile, a plunger 36 protrudes from the left end of the thermoelement 35 into the inside of the lid member 32 on the left. The plunger 36 has a leading end abutting on and held by a bent receiving portion 37*bb* of the retainer portion 37*b* integrally formed with the valve seat 37.

The second valve 34 is slidably fitted and journaled on a support bar 35*a* that integrally protrudes to the right from the temperature-sensing portion 35*t* of the thermoelement 35.

The second valve 34 that is restricted from moving by a retaining ring 39 engaged with the support bar 35*a* is urged to the right by a conical coil spring 42 disposed between the temperature-sensing portion 35*t* and the second valve 34.

The casing 31 includes a large-diameter cylindrical main portion 31*a* and a small-diameter cylindrical end portion 31*b*. The cylindrical main portion 31*a* is disposed to be closer to the lid member 32 (on the left). The small-diameter cylindrical end portion 31*b* having a reduced diameter is disposed in a protruding condition on the right of the cylindrical main portion 31*a*.

The second valve 34 abuts on a shoulder 31*c* between the cylindrical main portion 31*a* and the small-diameter cylindrical end portion 31*b* to thereby be closed. The second valve 34 is thereby able to partition the internal space of the cylindrical main portion 31*a* from the internal space of the small-diameter cylindrical end portion 31*b*.

FIG. 5 depicts a condition in which a temperature of coolant around the temperature-sensing portion 35*t* of the thermoelement 35 is low. FIG. 5 depicts that the first valve 33 and the thermoelement 35 are urged by the coil spring 41 to be moved to the left and the first valve 33 abuts on the valve seat 37 to be closed, so that the internal space of the casing 31 is partitioned from the internal space of the lid member 32; and the second valve 34 journaled on the support bar 35*a* of the thermoelement 35 leaves the shoulder 31*c* between the cylindrical main portion 31*a* and the small-diameter cylindrical end portion 31*b* of the casing 31 to be opened, thus providing communication between the internal space of the cylindrical main portion 31*a* and the internal space of the small-diameter cylindrical end portion 31*b*.

When the temperature of the coolant around the temperature-sensing portion 35*t* of the thermoelement 35 increases and the wax inside the temperature-sensing portion 35*t* expands to thereby push out the plunger 36, reaction involved in the leading end of the plunger 36 being held by the retainer portion 37*b* of the valve seat 37 resists the coil spring 41 to thereby move the thermoelement 35 to the right as depicted in FIG. 6.

Thus, the first valve 33 opens to provide communication between the internal space of the casing 31 and the internal space of the lid member 32. At the same time, the second valve 34 urged by the conical coil spring 42 abuts on the shoulder 31*c* to thereby closed, thus partitioning the internal space of the cylindrical main portion 31*a* from the internal space of the small-diameter cylindrical end portion 31*b*.

It is to be noted that a valve element of the second valve 34 has a through hole 34*p* that serves as a leak passage intended to allow coolant to leak even when the second valve 34 is closed.

An outflow connection pipe 44 is formed in a protruding manner on the lid member 32 of the thermostat valve 30. A radiator inflow hose 51 extending from the radiator 50 is connected with the outflow connection pipe 44.

Additionally, the casing 31 of the thermostat valve 30 has a communication path 45 opening to the internal space of the cylindrical main portion 31*a* of the casing 31. The communication path 45 is integrally formed in the rear lateral wall of the cylinder head 5, extending from the cylinder head water jacket 5W of the cylinder head 5.

A bypass communication path 46 that communicates with the internal space of the small-diameter cylindrical end portion 31*b* of the casing 31 extends in the rear lateral wall of the cylinder head 5 toward the cylinder portion 4 inferior to the cylinder head 5, to thereby be open in the abutment surface with respect to the cylinder portion 4.

Reference is made to FIG. 3. The cylinder portion 4 includes a bypass communication path 47 communicating with the bypass communication path 46 on the side of the cylinder head 5. The bypass communication path 47 is formed to be open to the abutment surface with respect to the cylinder head 5 and to extend downward. The bypass communication path 46 on the side of the cylinder head 5 communicates with the bypass communication path 47 on the side of the cylinder portion 4 via a communication hole 6*j* (see FIG. 3) in the gasket 6.

As shown in FIG. 3, the bypass communication path 47 of the cylinder portion 4 has a communication port 48 on the lower end thereof. The communication port 48 is aligned with the inflow communication port 17I (FIG. 3) in the partition member 15, so that the bypass communication path 47 communicates with the sub-cylinder water jacket 4Wb on the lower side.

Specifically, the internal space of the small-diameter cylindrical end portion 31*b* of the thermostat valve 30 communicates with the sub-cylinder water jacket 4Wb on the lower side of the cylinder water jacket 4W via the bypass communication paths 46 and 47.

Figure 7:
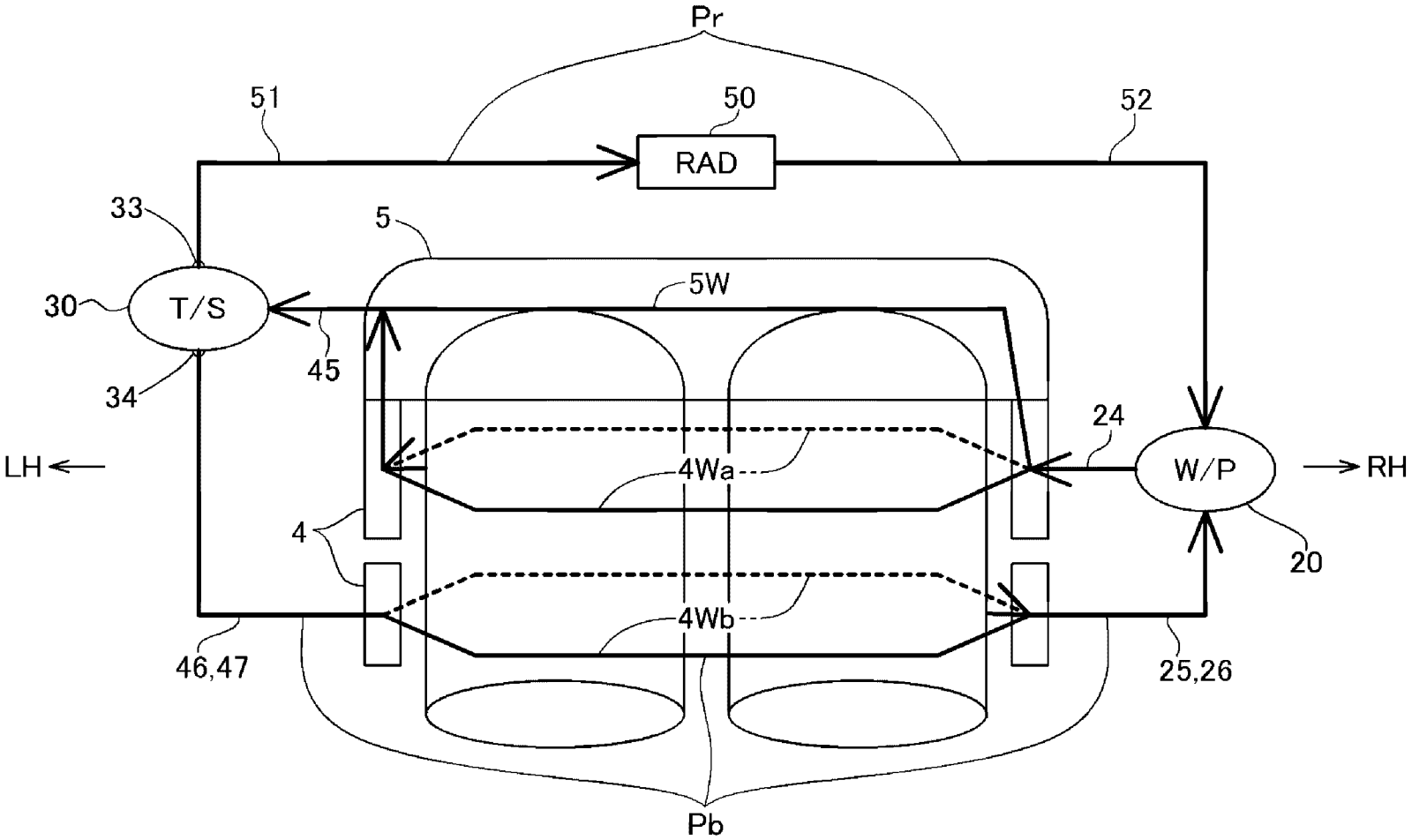
FIG. 7 is a diagram schematically depicting flow of coolant through the cooling structure for the internal combustion engine.

FIG. 7 schematically depicts flow of coolant through the cooling structure for the internal combustion engine 1 having configurations as described above.

The cylinder water jacket 4W as the loop-shaped tubular groove with the central constriction in the cylinder portion 4 is partitioned by the flange 15*f* of the partition member 15 into the main cylinder water jacket 4Wa on the side of the cylinder head 5 (upper side) and the sub-cylinder water jacket 4Wb on the side of the crankcase portion 3 (lower side). Each of the main cylinder water jacket 4Wa and the sub-cylinder water jacket 4Wb includes a front-side flow channel and a rear-side flow channel at the front and rear, respectively, communicating a left end portion of the cylinder portion 4 with a right end portion of the cylinder portion 4.

The main cylinder water jacket 4Wa on the upper side communicates with the cylinder head water jacket 5W of the cylinder head 5 via the communication holes 6*h* in the gasket 6 on the left and right end portions.

The thermostat valve 30 and the water pump 20 are disposed on the left-hand side and the right-hand side, respectively, of the engine main unit 2.

A radiator-routing passage Pr that passes through the radiator 50 includes the radiator inflow hose 51 through which coolant flows from the thermostat valve 30 on the left-hand side into the radiator 50 and the radiator outflow hose 52 through which the coolant flows from the radiator 50 out to the water pump 20 on the right-hand side. The radiator-routing passage Pr is opened or closed by the first valve 33 of the thermostat valve 30.

A bypass passage Pb that bypasses the radiator 50 between the thermostat valve 30 and the water pump 20 includes the bypass communication paths 46 and 47, the sub-cylinder water jacket 4Wb, the bypass communication hose 25, and the bypass passage hole 26. The bypass passage Pb is opened or closed by the second valve 34 of the thermostat valve 30.

As described above, the bypass passage Pb is configured using the sub-cylinder water jacket 4Wb, and only the bypass communication hose 25 is an external pipe, so that a considerable reduction in use of external pipes is achieved.

The sub-cylinder water jacket 4Wb existing in the cylinder portion 4 forms part of the bypass passage Pb. This facilitates formation of the bypass passage and reduces use of the external pipe in the bypass passage Pb. Thus, a simplified structure including a reduced number of parts can be configured, cost can be reduced, and a lightweight internal combustion engine can be built. Additionally, areas surrounding the engine main unit can be simplified and favorable appearance can be maintained.

During a warming-up operation at the start of the engine at which the coolant temperature is low, the first valve 33 is closed and the second valve 34 is opened in the thermostat valve 30, so that coolant delivered from the water pump 20 flows through the following circulation path. Specifically, the coolant from the delivery path 24 flows in a bifurcated manner into the main cylinder water jacket 4Wa and into the front-side flow channel and rear-side flow channel of the cylinder head water jacket 5W, flows from the communication path 45 into the cylindrical main portion 31*a* of the thermostat valve 30, and flows via the open second valve 34 through the bypass passage Pb before returning to the water pump 20.

Thus, the coolant that has flowed though, and heated by mainly the main cylinder water jacket 4Wa and the cylinder head water jacket 5W dissipates, when flowing through the bypass passage Pb that bypasses the radiator 50, only a minimal amount of heat in the region of the bypass communication hose 25 which is shortened by reduction of the external pipe used. Additionally, the coolant is heated in the sub-cylinder water jacket 4Wb, so that the further increase in temperature in the sub-cylinder water jacket 4Wb expedites warming-up of the engine.

When the coolant temperature increases to a certain level as a result of the warming-up operation of the internal combustion engine, the engine initiates an ordinary operation by closing the second valve 34 and opening the first valve 33 in the thermostat valve 30 and the coolant delivered from the water pump 20 flows through the following circulation path. Specifically, the coolant from the delivery path 24 flows in a bifurcated manner into the main cylinder water jacket 4Wa and into the front-side flow channel and rear-side flow channel of the cylinder head water jacket 5W, flows through the communication path 45 into the cylindrical main portion 31*a* of the thermostat valve 30, and flows via the open first valve 33 through the radiator-routing passage Pr that is routed through the radiator 50, before returning to the water pump 20.

Thus, the coolant cooled by the radiator 50 flows through the main cylinder water jacket 4Wa and the cylinder head water jacket 5W, thereby cooling the cylinder portion 4 and the cylinder head 5.

It is to be noted here that, as described previously, the main cylinder water jacket 4Wa on the side adjacent the cylinder head 5 has a volume greater than the volume of the sub-cylinder water jacket 4Wb on the side adjacent the crankcase portion 3. Thus, the cylinder portion 4 can be efficiently cooled during the ordinary operation of the internal combustion engine 1 following the warming-up operation, while the sub-cylinder water jacket 4Wb is being used as the bypass passage.

As described previously, the valve element of the second valve 34 has the through hole 34*p* that serves as the leak passage. Thus, coolant leaks through the through hole 34*p* to the bypass passage Pb even when the second valve 34 is closed during the ordinary operation. A minimal amount of coolant is thereby allowed to flow through the sub-cylinder water jacket 4Wb. Uneven cooling performance of the cylinder portion 4 can thus be prevented and the cylinder portion 4 can be cooled even more effectively.

With the thermostat valve 30, its casing 31 is integrally formed on the rear lateral wall of the cylinder head 5. Thus, the bypass communication path 46 on the side of the cylinder head 5 and the bypass communication path 47 on the side of the cylinder portion 4 can form part of the bypass passage Pb that is opened or closed by the second valve 34 of the thermostat valve 30, specifically, the part between the second valve 34 and the sub-cylinder water jacket 4Wb of the cylinder portion 4. Use of the external pipe can thereby be further reduced, so that heat dissipation from the external pipe during the warming-up operation can be further reduced and warming-up can be further expedited.

In addition, the reduction in use of the external pipe shortens the bypass passage Pb as much as possible, so that pipe resistance can be minimized.

The water pump 20 is disposed on the side opposite to the thermostat valve 30 in a direction in which the cylinder bores 4*b* are arrayed in the internal combustion engine 1.

Specifically, the thermostat valve 30 and the water pump 20 are disposed, respectively, on both sides of a line of arrangement of the cylinder bores 4*b*. This configuration allows the sub-cylinder water jacket 4Wb to form a substantial part of the bypass passage Pb. Thus, the use of the external pipe can be reduced and heat dissipation from the external pipe can be reduced for expediting warming-up operation. Additionally, appearance can be enhanced and reduction in size and weight of the internal combustion engine can be further promoted.

Additionally, as shown in FIG. 7, the sub-cylinder water jacket 4Wb forming the bypass passage Pb includes the two flow channels of the front-side flow channel and the rear-side flow channel through which coolant is passed in the direction in which the cylinder bores 4*b* are arrayed, so that the coolant is allowed to flow through the two flow channels in a bifurcated manner in the same directions. More specifically, the configuration results in an increased flow channel cross-sectional area, a shortened flow channel length, and a reduced pipe resistance. Thus, the internal combustion engine 1 can be further reduced in size through the use of a compact water pump of a small pump capacity.

Reference is made back to FIG. 1. The starter motor 55 is disposed on the crankcase portion 3 along the rear lateral surface of the cylinder portion 4 and adjacent the cylinder portion 4 extending above the crankcase portion 3. The rear lateral portion of the sub-cylinder water jacket 4Wb disposed in the cylinder portion 4 on the side (lower side) adjacent to the crankcase portion 3 is located between the cylinder bores 4*b* and the starter motor 55. The foregoing arrangement enables the coolant flowing through the sub-cylinder water jacket 4Wb to block heat generated by the cylinder bores 4*b*, to thereby reduce thermal effect on the starter motor 55.

Figure 8:
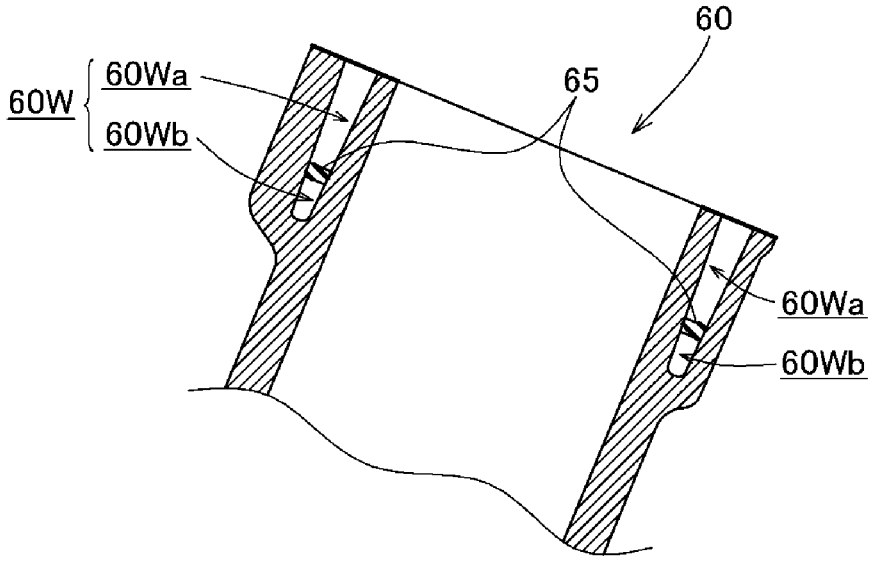
FIG. 8 is a sectional view of a cylinder portion illustrating an example in which a cylinder water jacket is partitioned by another partition member.

With the cooling structure for an internal combustion engine according to the embodiment described above, in order to partition the cylinder water jacket 4W of the cylinder portion 4 into the main cylinder water jacket 4Wa on the side of the cylinder head 5 (upper side) and the sub-cylinder water jacket 4Wb on the side of the crankcase portion 3 (lower side), the partition member 15 as the tubular plate member is fitted into the cylinder water jacket 4W to use the flange 15*f* of the partition member 15 to serve as a partition. FIG. 8 depicts a first modification of the partition member.

In the first modification, a cylinder water jacket 60W of a cylinder portion 60 has a groove width that gradually tapers to be narrower from a groove opening toward a groove bottom surface. An annular, string-shaped partition member 65 is fitted into the cylinder water jacket 60W.

The partition member 65 is formed of a resin or rubber and has a trapezoidal cross section.

The partition member 65, when having been press-fitted into a predetermined depth in the cylinder water jacket 60W, can partition the cylinder water jacket 60W into a main cylinder water jacket 60Wa on the side of the cylinder head (upper side) and a sub-cylinder water jacket 60Wb on the side of the crankcase portion (lower side) by being caught in the tapered groove in the cylinder water jacket 60W.

Figure 9:
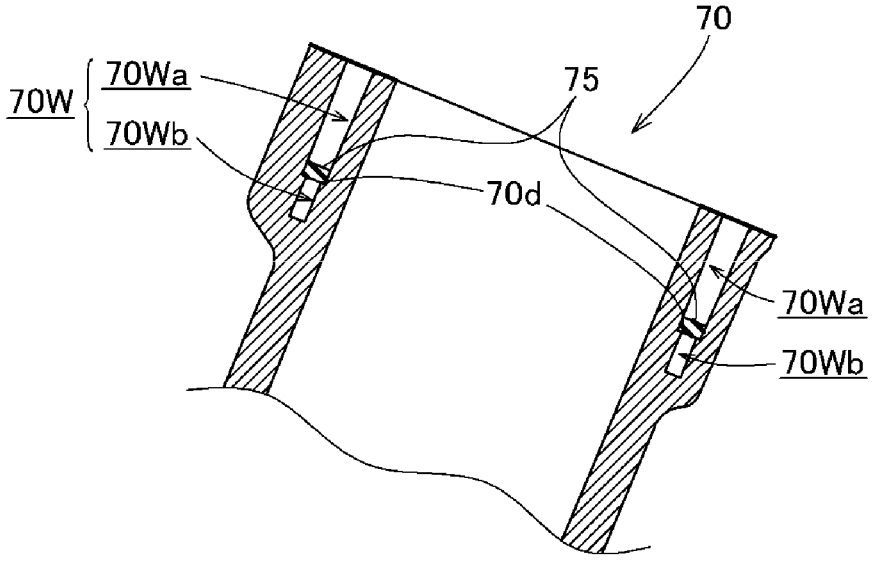
FIG. 9 is a sectional view of a cylinder portion illustrating an example in which a cylinder water jacket is partitioned by still another partition member.

FIG. 9 depicts a second modification.

In the second modification, a cylinder water jacket 70W of a cylinder portion 70 has a groove width that is suddenly narrowed at a predetermined depth to thereby form a shoulder 70*d*. An annular, string-shaped partition member 75 is fitted onto the shoulder 70*d*. The partition member 75 functions to partition the cylinder water jacket 70W into a main cylinder water jacket 70Wa on the side of the cylinder head (upper side) and a sub-cylinder water jacket 70Wb on the side of the crankcase portion (lower side).

In the first and second modifications depicted in FIGS. 8 and 9, the cylinder water jackets 60W and 70W can be partitioned readily using the annular, string-shaped partition members 65 and 75, so that reduction in cost can be achieved.

Figure 10:
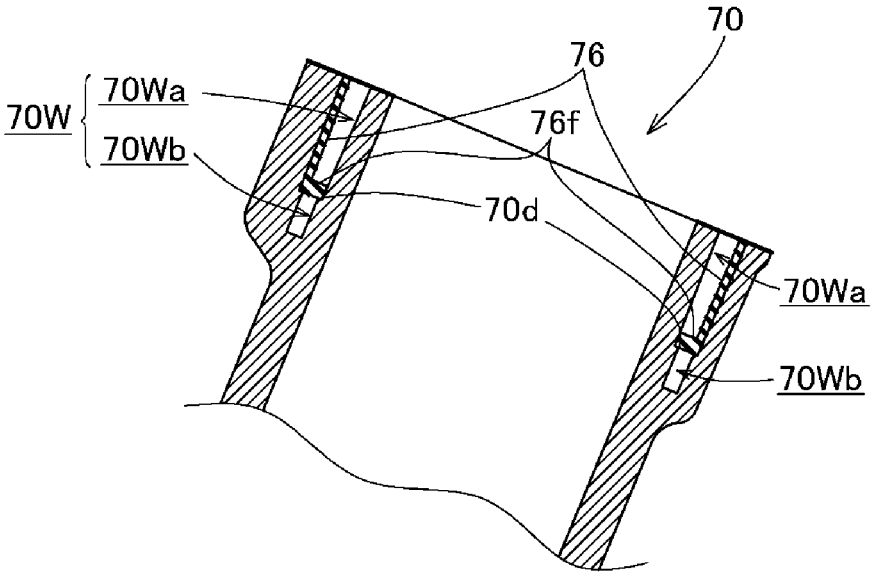
FIG. 10 is a sectional view of a cylinder portion illustrating an example in which a cylinder water jacket is partitioned by a further partition member.

FIG. 10 depicts a third modification in which a partition member 76 different from the partition member 75 is fitted in the cylinder water jacket 70W in the cylinder portion 70 shown in FIG. 9, to thereby partition the cylinder water jacket 70W into the main cylinder water jacket 70Wa and the sub-cylinder water jacket 70Wb.

The partition member 76 is a loop-shaped tubular plate member having a thickness thinner than a groove width of the cylinder water jacket 70W. The partition member 76 has a flange 76*f* formed at the lower end thereof. The flange 76*f* protrudes toward the inside.

The partition member 76 has an outer peripheral surface in contact with an outer groove peripheral surface of the cylinder water jacket 70W. The partition member 76 is fitted in to a degree in which the flange 76*f* abuts on the shoulder 70*d*. Then, the flange 76*f* of the partition member 76 partitions the cylinder water jacket 70W into the main cylinder water jacket 70Wa and the sub-cylinder water jacket 70Wb.

Figure 11:
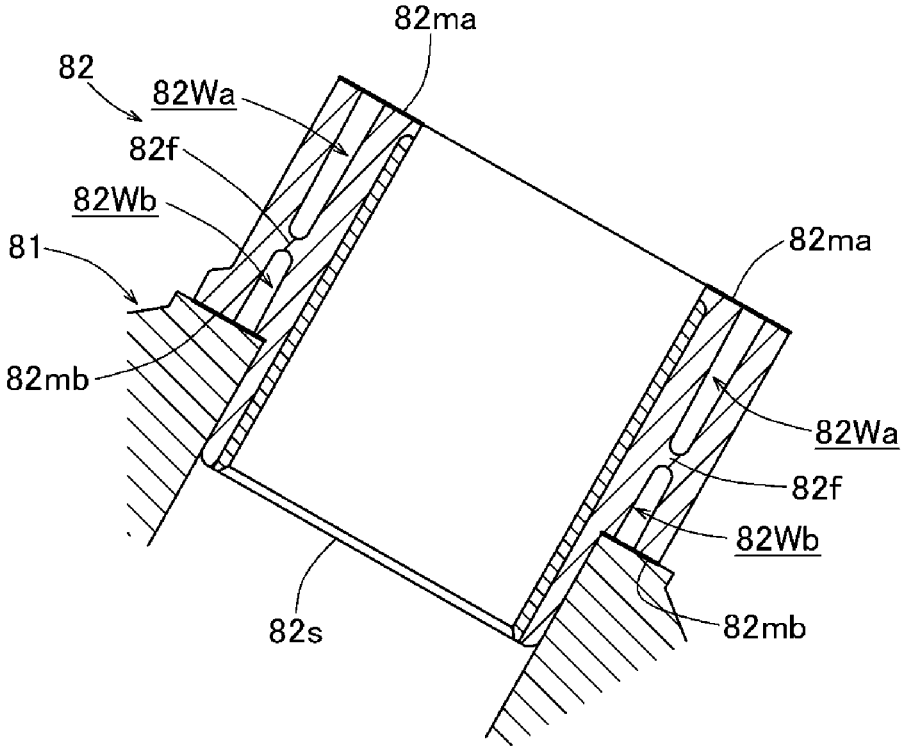
FIG. 11 is a sectional view of a crankcase portion and a cylinder portion of an example in which a cylinder water jacket in the cylinder portion separate from the crankcase portion is partitioned.

FIG. 11 depicts an example in which, in an engine main unit including a cylinder portion separate from a crankcase portion, a cylinder water jacket in a cylinder portion 82 is partitioned into a main cylinder water jacket 82Wa on the side of the cylinder head (upper side) and a sub-cylinder water jacket 82Wb on the side of the crankcase portion (lower side).

The cylinder portion 82 separate from a crankcase portion 81 has a cylinder sleeve 82*s* extending below an abutment surface 82*mb* with respect to the crankcase portion 81 and reaching into the crankcase portion 81.

A tubular groove in the main cylinder water jacket 82Wa is formed to be open to an abutment surface 82*ma* of the cylinder portion 82 with respect to the cylinder head on the side opposite to the abutment surface 82*mb*. A tubular groove in the sub-cylinder water jacket 82Wb is formed to be open to the abutment surface 82*mb*.

A groove bottom in the main cylinder water jacket 82Wa is close to a groove bottom in the sub-cylinder water jacket 82Wb and a partition portion 82*f* is formed between the groove bottoms.

For the configuration in which the crankcase portion 81 is separate from the cylinder portion 82 in the engine main unit, molding the cylinder portion 82 to configure the main cylinder water jacket 82Wa and the sub-cylinder water jacket 82Wb results in forming the partition portion 82*f*. This eliminates the need for a separate partition member to be fabricated.

Figure 12:
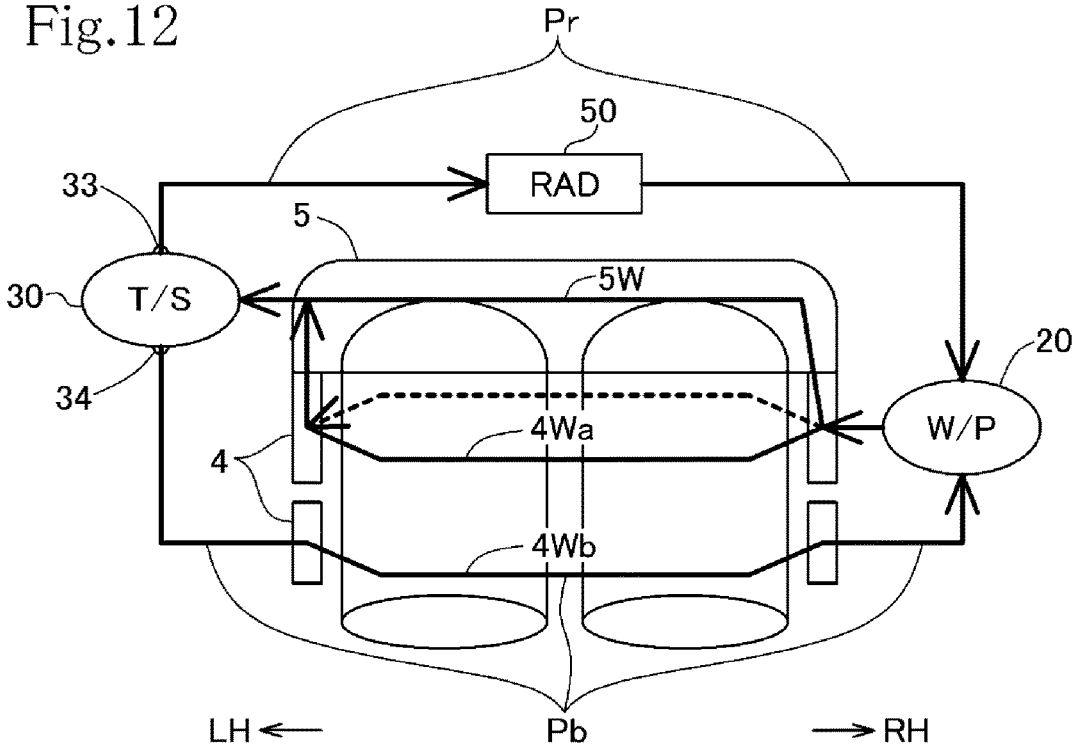
FIG. 12 is a diagram schematically depicting another flow route of coolant.

In the cooling structure for an internal combustion engine depicted in FIG. 7, the bypass passage Pb is configured such that the coolant flows between the left and right ends of the sub-cylinder water jacket 4Wb in the cylinder portion 4 through the front-side flow channel and the rear-side flow channel in a parallelly bifurcated manner. An alternative configuration may nonetheless be possible in which coolant flows through only the rear-side flow channel as depicted in FIG. 12.

Because the rear-side flow channel of the sub-cylinder water jacket 4Wb in the cylinder portion 4 is not exposed to air flow, the coolant that flows through the rear-side flow channel that is unlikely to dissipate heat is efficiently heated, so that warming-up can be expedited.

Figure 13:
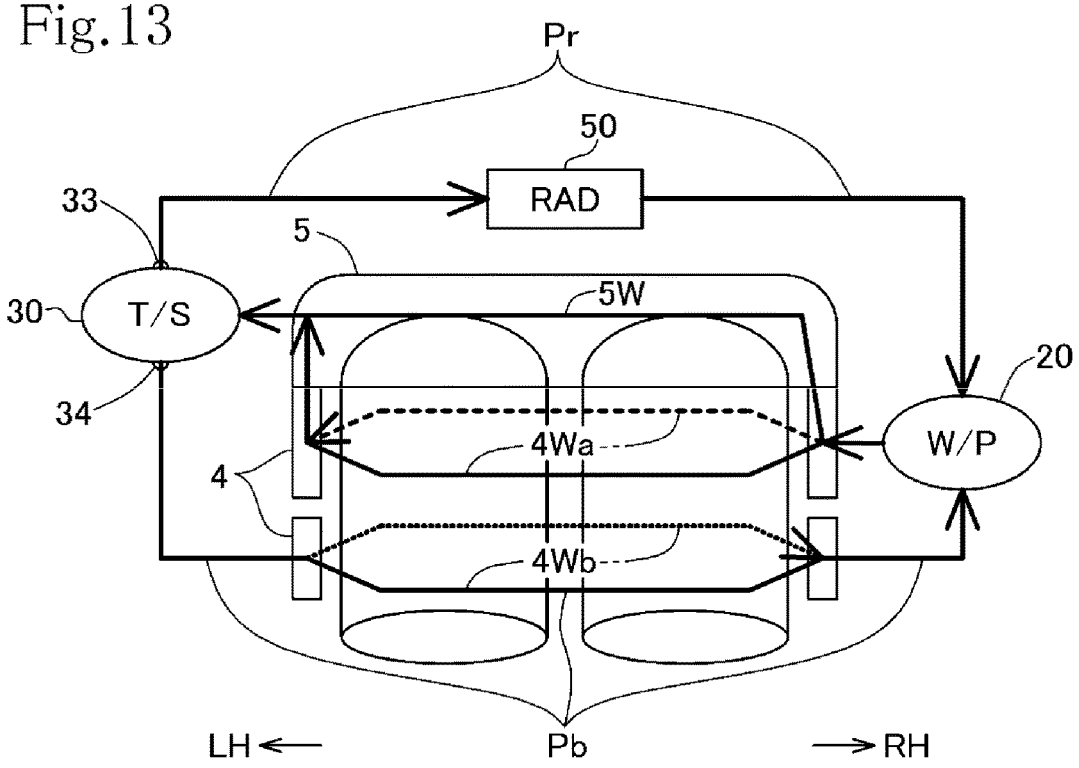
FIG. 13 is a diagram schematically depicting still another flow route of coolant.

In a cooling structure depicted in FIG. 13, coolant is passed between the left and right ends of the cylinder portion 4 through front-side flow channels and rear-side flow channels in a parallelly bifurcated manner, and coolant flowing through the rear-side flow channel (indicated by the solid line) of the sub-cylinder water jacket 4Wb has a flow rate set to be greater than a flow rate of coolant flowing through the front-side flow channel (indicated by the dotted line).

The flow rate of coolant flowing through the rear-side flow channel from which heat is not readily dissipated is set to be greater to thereby increase the temperature of the coolant efficiently. In addition, the coolant is passed through both the front-side flow channel and the rear-side flow channel, to thereby reduce pipe resistance, so that pump capacity can be reduced.

Figure 14:
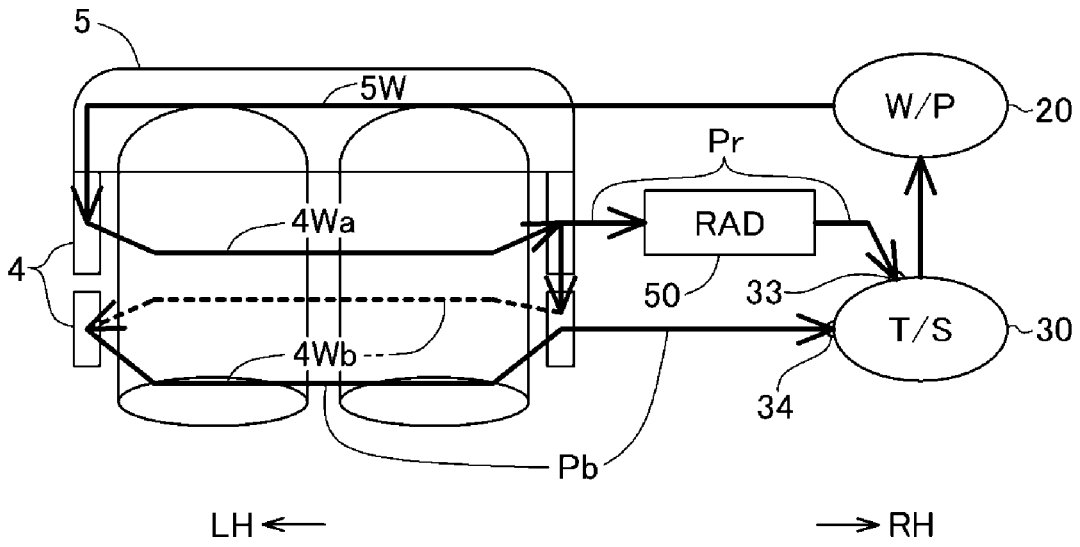
FIG. 14 is a diagram schematically depicting a flow route of coolant in a configuration in which a water pump and a thermostat are disposed on an identical side in the engine main unit.
Figure 15:
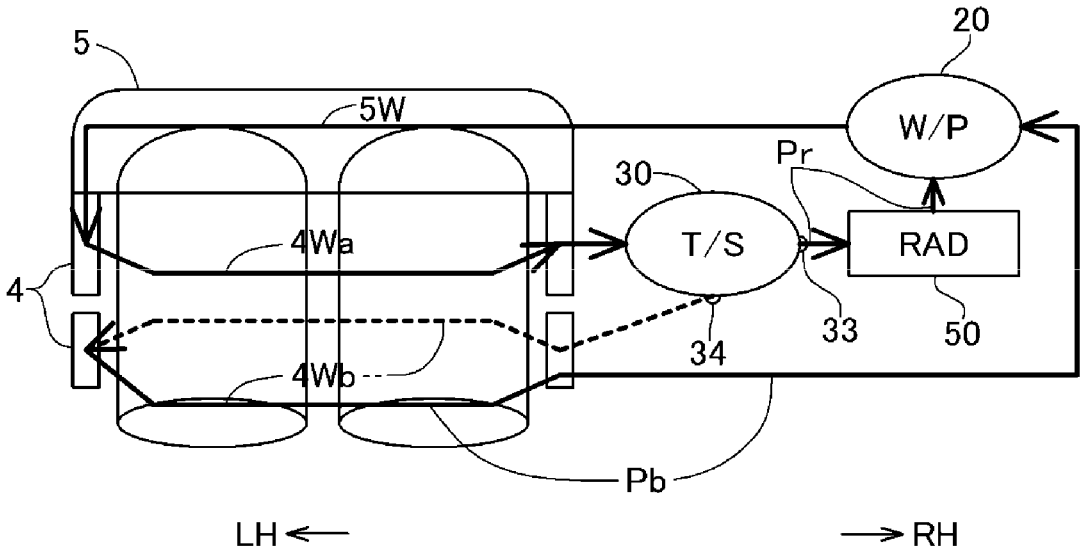
FIG. 15 is a diagram schematically depicting a further flow route of coolant.

Each of the cooling structures for internal combustion engines depicted in FIGS. 7, 12, and 13 assumes that the thermostat valve 30 and the water pump 20 are disposed on two ends of a line in the direction in which the cylinder bores 4*b* are arrayed (lateral direction). FIGS. 14 and 15 depict cooling structures in which the thermostat valve 30 and the water pump 20 are disposed on one of the two ends.

It is to be noted that the engine is the inline two-cylinder, four-stroke water-cooled internal combustion engine, the same as the internal combustion engine described previously. Like elements are identified by like reference numerals.

The thermostat valve 30 and the water pump 20 are disposed on the same right-hand side in the engine main unit. In the cooling structure for an internal combustion engine depicted in FIG. 14, coolant delivered from the water pump 20 flows from the right end of the cylinder head 5 into the cylinder head water jacket 5W and, at the left end, flows further onto the main cylinder water jacket 4Wa; the coolant then flows through the rear-side flow channel of the main cylinder water jacket 4Wa to the right; at the right end, the coolant is branched into the radiator-routing passage Pr by way of the radiator 50 and into the bypass passage Pb.

The radiator-routing passage Pr is opened or closed by the first valve 33 of the thermostat valve 30.

Meanwhile, the rear-side flow channel of the main cylinder water jacket 4Wa is branched into the front-side flow channel (indicated by the dotted line) of the sub-cylinder water jacket 4Wb. The front-side flow channel leads into the rear-side flow channel (indicated by the solid line) of the sub-cylinder water jacket 4Wb. The bypass passage Pb formed by the sub-cylinder water jacket 4Wb is connected to the thermostat valve 30 by way of its second valve 34. The bypass passage Pb is opened or closed by the second valve 34.

As such, the sub-cylinder water jacket 4Wb as the bypass passage Pb represents a circuit route around the inline cylinder bores, extending from the right end in a cylinder array direction through the front-side flow channel, by way of the left end of the rear-side flow channel, back to the right end. Thus, the coolant is heated by the long flow channel of the bypass passage during the warming-up operation, so that warming-up is even further expedited.

The thermostat valve 30 and the water pump 20 are disposed on the same right-hand side in the direction in which the cylinder bores are arrayed. Thus, a major part of the bypass passage Pb can be formed using the sub-cylinder water jacket 4Wb. The use of the external pipe can thus be reduced and heat dissipation from the external pipe can be reduced for expediting of warming-up. Additionally, appearance can be improved and reduction in size and weight of the internal combustion engine can be further promoted.

In the cooling structure for an internal combustion engine depicted in FIG. 15, coolant delivered from the water pump 20 flows from the right end of the cylinder head 5 into the cylinder head water jacket 5W and, at its left end, flows further onto the main cylinder water jacket 4Wa; the coolant then flows through the rear-side flow channel 4Wa of the main cylinder water jacket 4Wa to the right to reach the right end. The flow route up to this point is the same as that of the cooling structure depicted in FIG. 14. From the right end of the main cylinder water jacket 4Wa, the coolant flows to the thermostat valve 30.

The first valve 33 of the thermostat valve 30 opens or closes the radiator-routing passage Pr by way of the radiator 50.

The bypass passage Pb opened or closed by the second valve 34 of the thermostat valve 30 extends through the front-side flow channel (indicated by the dotted line) of the sub-cylinder water jacket 4Wb to the rear-side flow channel (indicated by the solid line) of the same. The rear-side flow channel of the sub-cylinder water jacket 4Wb is connected to the water pump 20.

Thus, as with the cooling structure depicted in FIG. 14, the sub-cylinder water jacket 4Wb as the bypass passage Pb represents a circuit route around the inline cylinder bores, extending from the right end in the cylinder array direction through the front-side flow channel, by way of the left end of the rear-side flow channel, back to the right end. Thus, the coolant is heated by the long flow channel of the bypass passage during the warming-up operation, so that warming-up is even further expedited. Additionally, appearance can be improved through reduction in use of the external pipe and reduction in size and weight of the internal combustion engine can be further promoted.

Although the cooling structures for an internal combustion engine according to the specific embodiments of the present invention have been described, it will be understood that the present invention may be embodied in other specific forms without departing from the spirit or essential characteristics thereof, including, for example, an internal combustion engine in which the thermostat is disposed separately from the cylinder head and connected by a coolant hose.

The embodiment described with reference to FIGS. 1 to 7 includes, as part of the bypass passage Pb, the bypass communication hose 25 as the external pipe. The bypass passage Pb can nonetheless be configured without including the external pipe through the following approach. Specifically, instead of the bypass communication hose 25, a coolant passage that provides communication between the sub-cylinder water jacket 4Wb of the cylinder portion 4 and the bypass passage hole 26 in the right case cover 9 is formed inside the walls of the cylinder portion 4 and the right case cover 9. This approach considerably reduces heat dissipation of the bypass passage Pb during the warming-up operation, so that warming-up can be expedited even further.

DESCRIPTION OF REFERENCE SYMBOLS

1: Internal combustion engine
2: Engine main unit
3: Crankcase portion
3*a*: Upper-side crankcase
3*b*: Lower-side crankcase
4: Cylinder portion
4*b*: Cylinder bore
4W: Cylinder water jacket
4Wa: Main cylinder water jacket
4Wb: Sub-cylinder water jacket
4J: Connection opening
5: Cylinder head (cylinder head portion)
5*b*: Combustion chamber
5*i*: Intake port
5*p*: Intake connection pipe portion
5*e*: Exhaust port
5W: Cylinder head water jacket
6: Gasket
7: Cylinder head cover
8: Left case cover
9: Right case cover
10: Crankshaft
15: Partition member
15*f*: Flange
17I: Inflow communication port
17E: Outflow communication port
18I: Inflow communication port
20: Water pump
20*a*: Impeller
21: Pump cover
21*a*: Intake chamber
22: Intake connection pipe
24: Delivery path
24*a*: Delivery port
25: Bypass communication hose
26: Bypass passage hole
30: Thermostat valve
31: Casing
31*a*: Cylindrical main portion
31*b*: Small-diameter cylindrical end portion
32: Lid member
33: First valve
34: Second valve
35: Thermoelement
35*t*: Temperature-sensing portion
35*a*: Support bar
36: Plunger
37: Valve seat
37*a*: Annular seat portion
37*b*: Retainer portion
38: Spring receiving support member
39: Retaining ring
41: Coil spring
42: Conical coil spring
44: Outflow connection pipe
45: Communication path
46: Bypass communication path
47: Bypass communication path
48: Communication port
50: Radiator
51: Radiator inflow hose
52: Radiator outflow hose
55: Starter motor
60: Cylinder portion
60W: Cylinder water jacket
60Wa: Main cylinder water jacket
60Wb: Sub-cylinder water jacket
65: Partition member
70: Cylinder portion
70W: Cylinder water jacket
70Wa: Main cylinder water jacket
70Wb: Sub-cylinder water jacket
75: Partition member
81: Crankcase portion
82: Cylinder portion
82*s*: Cylinder sleeve
82*f*: Partition portion
82Wa: Main cylinder water jacket
82Wb: Sub-cylinder water jacket

The invention claimed is:

1. A cooling structure for an internal combustion engine comprising: an engine main unit including a crankcase portion, a cylinder portion, and a cylinder head portion, the cylinder portion and the cylinder head portion having therein a cylinder coolant jacket and a cylinder head coolant jacket, respectively; a coolant pump for circulating coolant through coolant circulation paths formed in the cylinder coolant jacket and the cylinder head coolant jacket, the coolant circulation path paths including a radiator-routing passage by way of a radiator and a bypass passage bypassing the radiator, the radiator-routing passage and the bypass passage returning back to the coolant pump; and a thermostat valve for changing over between coolant circulation through the radiator-routing passage and coolant circulation through the bypass passage, wherein the thermostat valve includes a first valve for opening and closing the radiator-routing passage, and a second valve for opening and closing the bypass passage, the first valve and the second valve being operated concurrently; wherein the cylinder coolant jacket is disposed around a cylinder bore in the cylinder portion and is partitioned into two in a cylinder axis direction to thereby form a main cylinder coolant jacket on a side of the cylinder head portion and a sub-cylinder coolant jacket on a side of the crankcase portion, wherein the coolant pump is connected to the thermostat valve by way of the main cylinder coolant jacket and the cylinder head coolant jacket, and wherein the thermostat valve is connected to the coolant pump by way of the sub-cylinder coolant jacket, which forms a part of the bypass passage bypassing the radiator.

2. The cooling structure for an internal combustion engine according to claim 1, wherein the main cylinder coolant jacket has a volume greater than a volume of the sub-cylinder coolant jacket.

3. The cooling structure for an internal combustion engine according to claim 2, wherein the second valve has formed therein a leak passage through which coolant leaks when the second valve is in a closed position.

4. The cooling structure for an internal combustion engine according to claim 2, wherein the thermostat valve is integrated with the engine main unit.

5. The cooling structure for an internal combustion engine according to claim 2, wherein the cylinder portion is disposed to extend superiorly from the crankcase portion;

a starting motor is disposed on the crankcase portion adjacent the cylinder portion; and the starter motor is disposed on a side of the cylinder bores with part of the sub-cylinder coolant jacket positioned between the cylinder bores and the starter motor.

6. The cooling structure for an internal combustion engine according to claim 1, wherein the second valve has formed therein a leak passage through which coolant leaks when the second valve is in a closed position.

7. The cooling structure for an internal combustion engine according to claim 6, wherein the thermostat valve is integrated with the engine main unit.

8. The cooling structure for an internal combustion engine according to claim 6, wherein the cylinder portion is disposed to extend superiorly from the crankcase portion;

a starting motor is disposed on the crankcase portion adjacent the cylinder portion; and the starter motor is disposed on a side of the cylinder bores with part of the sub-cylinder coolant jacket positioned between the cylinder bores and the starter motor.

9. The cooling structure for an internal combustion engine according to claim 1, wherein the thermostat valve is integrated with the engine main unit.

10. The cooling structure for an internal combustion engine according to claim 6, wherein:

the cylinder portion includes a plurality of cylinder bores arrayed in series with each other; and the thermostat valve is disposed adjacent one of outermost cylinder bores disposed on two lateral ends in a direction in which the cylinder bores are arrayed.

11. The cooling structure for an internal combustion engine according to claim 10, wherein the coolant pump is disposed on a side opposite to the thermostat valve in the direction in which the cylinder bores are arrayed in the internal combustion engine.

12. The cooling structure for an internal combustion engine according to claim 11, wherein the cylinder portion is disposed to extend superiorly from the crankcase portion;

a starting motor is disposed on the crankcase portion adjacent the cylinder portion; and the starter motor is disposed on a side of the cylinder bores with part of the sub-cylinder coolant jacket positioned between the cylinder bores and the starter motor.

13. The cooling structure for an internal combustion engine according to claim 10, wherein the coolant pump is disposed on a side identical to a side on which the thermostat valve is disposed in the direction in which the cylinder bores are arrayed in the internal combustion engine.

14. The cooling structure for an internal combustion engine according to claim 13, wherein the cylinder portion is disposed to extend superiorly from the crankcase portion;

a starting motor is disposed on the crankcase portion adjacent the cylinder portion; and the starter motor is disposed on a side of the cylinder bores with part of the sub-cylinder coolant jacket positioned between the cylinder bores and the starter motor.

15. The cooling structure for an internal combustion engine according to claim 10, wherein the cylinder portion is disposed to extend superiorly from the crankcase portion;

a starting motor is disposed on the crankcase portion adjacent the cylinder portion; and the starter motor is disposed on a side of the cylinder bores with part of the sub-cylinder coolant jacket positioned between the cylinder bores and the starter motor.

16. The cooling structure for an internal combustion engine according to claim 9, wherein the cylinder portion is disposed to extend superiorly from the crankcase portion;

a starting motor is disposed on the crankcase portion adjacent the cylinder portion; and the starter motor is disposed on a side of the cylinder bores with part of the sub-cylinder coolant jacket positioned between the cylinder bores and the starter motor.

17. The cooling structure for an internal combustion engine according to claim 1, wherein:

the cylinder portion is disposed to extend superiorly from the crankcase portion;

a starting motor is disposed on the crankcase portion adjacent the cylinder portion; and the starter motor is disposed on a side of the cylinder bores with part of the sub-cylinder coolant jacket positioned between the cylinder bores and the starter motor.

* * * * *